US008113188B2

(12) United States Patent
Ma

(10) Patent No.: US 8,113,188 B2
(45) Date of Patent: Feb. 14, 2012

(54) TOY AIR GUN

(75) Inventor: Chor-Ming Ma, Kowloon (CN)

(73) Assignee: Buzz Bee Toys (H.K.) Co., Limited, Kowloon, Hong Kong (CN)

( * ) Notice: Subject to any disclaimer, the term of this patent is extended or adjusted under 35 U.S.C. 154(b) by 101 days.

(21) Appl. No.: 12/658,129

(22) Filed: Feb. 3, 2010

(65) Prior Publication Data

US 2011/0146645 A1 Jun. 23, 2011

(30) Foreign Application Priority Data

Dec. 23, 2009 (HK) ..... 09112119.2

(51) Int. Cl.
*F41B 11/00* (2006.01)
*F41B 11/32* (2006.01)

(52) U.S. Cl. ..... 124/59; 124/66

(58) Field of Classification Search ..... 124/5, 66, 124/719

See application file for complete search history.

(56) References Cited

U.S. PATENT DOCUMENTS 2,237,678 A * 4/1941 Lohr et al. ..... 124/66
4,848,307 A 7/1989 Tsao
5,186,156 A * 2/1993 Clayton ..... 124/59
5,373,832 A * 12/1994 D'Andrade ..... 124/69
5,592,931 A * 1/1997 Johnson et al. ..... 124/69
5,680,853 A 10/1997 Clayton
5,797,385 A * 8/1998 Thai ..... 124/66
5,878,734 A 3/1999 Johnson et al.
6,698,414 B1 * 3/2004 Menow et al. ..... 124/69
2004/0040551 A1 * 3/2004 Menow et al. ..... 124/71

FOREIGN PATENT DOCUMENTS

CN 2121008 U 11/1992
CN 1483990 A 3/2001

OTHER PUBLICATIONS

English Translation of the Abstract for CN1483990A.
English Translation of the Abstract for CN2121008U.

* cited by examiner

*Primary Examiner* — Troy Chambers
(74) *Attorney, Agent, or Firm* — Alix, Yale & Ristas, LLP

(57) ABSTRACT

A toy gun includes a body, a piston adapted to move relative to the body between an extended position and a retracted position and to be moved rapidly toward the retracted position during a firing stroke. A number of firing chambers each receive a projectile and air compressed by the piston during a firing stroke to fire the projectile from the toy gun. An air delivery mechanism conveys the compressed air to one of the firing chambers and co-operates with the piston to advance as a result of piston movement to a configuration whereat it can convey compressed air to another of the chambers.

11 Claims, 11 Drawing Sheets

TOY AIR GUN

BACKGROUND

The present disclosure relates to multi-projectile toy guns. The disclosure more particularly, although not exclusively, relates to toy guns in which air is used to propel a succession of soft projectiles.

It is known to propel soft projectiles from toy guns using air as the propellant. In some toy guns, air is rapidly compressed behind a projectile to force the projectile to fire from the toy gun. For some toy guns, a method is required to prime the gun prior to pulling a trigger to cause firing. Priming might be by pump-action to load a piston against a compression spring for example. The trigger would release the piston so as to move rapidly forward—compressing air behind the projectile. In other toy guns, there is no separate priming action. Instead, two handles are provided for grasping by separate hands. One handle is fixed with respect to the body of the gun whereas the other is fixed with respect to a piston. The two handles are reciprocated toward and away from each other and during the forward stroke air is compressed behind the projectile to cause it to be ejected.

In multi-projectile toy guns of the type described above, some means is required to present the projectiles in succession to the firing position. For example, a barrel, magazine or "ammunition chain" might be loaded with projectiles. After one projectile is fired, a cylinder or ammunition chain must be advanced one position. With a gravity-feed magazine extending above the firing position, the next projectile might simply fall into position, but some means of mechanically advancing projectiles in a side or bottom-mounted magazine would be required.

Toy guns with projectile advancing mechanisms are disclosed in U.S. Pat. Nos. 5,186,156 and 5,680,853 but each of these has a complex mechanism to cause advancement of the projectiles during a cocking operation of the toy gun. Moreover, complex systems of levers, ratchets and pawls are designed to cause the advancing mechanism to function during a reverse stroke of a plunger and then some further means is required to maintain alignment of the parts during the firing stroke. This is unnecessarily complex and expensive to manufacture.

SUMMARY

Briefly stated, there is disclosed herein a toy gun, comprising:

a body;

a piston adapted to move relative to the body between an extended position and a retracted position and to be moved rapidly toward the retracted position during a firing stroke;

a plurality of firing chambers each adapted to receive a projectile and to receive air compressed by the piston during a said firing stroke to fire the projectile from the toy gun, and an air delivery mechanism adapted to convey the compressed air to one of the firing chambers and co-operating with the piston to advance as a result of piston movement to a configuration whereat it can convey compressed air to another of the chambers.

Preferably, the toy gun further comprises a first handle extending from the body to be grasped by one hand and a second handle extending from the piston to be grasped by another hand.

The toy gun can further comprise a trigger associated with the first handle for releasing the piston.

Preferably, each firing chamber further comprises an ejection nozzle via which air compressed by the piston is delivered to a projectile during the firing stroke.

Preferably, the toy gun further comprises a pressure chamber situated between the firing chambers and the piston and via which the compressed air is conveyed to the firing chambers.

Preferably, said plurality of said firing chambers is in a circular array.

Preferably, the air delivery mechanism comprises a disc rotatable within the pressure chamber, the disc having a port aligned with one of the firing chambers, and means for rotatably indexing the disc to align the port with another one of the firing chambers.

Preferably, the port has a check valve across it.

Alternatively, the port can include a tube extending into the pressure chamber.

Preferably, the toy gun further comprises a seal for sealing the port against each firing chamber.

Preferably, the disc is adapted to move linearly within the pressure chamber.

Preferably, said means for rotatably indexing the disc comprises a substantially cylindrical hub fixed with respect to the body and a ring attached to or formed integrally with the disc and surrounding the hub, the hub having an array of indexing fingers, the ring having one or more cams which engage upon linear movement of the disc with one or more of the fingers to rotate the disc.

Preferably, the disc is biased by a spring toward the firing chambers.

Alternatively, the air delivery mechanism comprises a conduit extending from the pressure chamber to one of the firing chambers, and means for rotatably advancing the conduit to align the conduit with another one of the firing chambers.

The means for rotatably advancing the conduit can comprise a substantially cylindrical hub fixed with respect to the conduit and a cam attached to the piston, the hub having an array of indexing fingers, the cam engage upon movement of the piston with one or more of the indexing fingers to rotate the hub and conduit.

BRIEF DESCRIPTION OF THE DRAWINGS

With reference to the drawings:

FIGS. 4A to 9A are schematic end elevations of a toy gun barrel having multiple firing chambers and soft projectiles located within some of the firing chambers. The number of and position of the projectiles corresponds figure-to-figure with FIGS. 4B to 9B alongside these figures respectively;

FIGS. 4B to 9B are schematic cross-sectional elevations of a toy gun showing a sequence of configurations of internal compartments during priming and firing of the toy gun;

DESCRIPTION OF THE PREFERRED EMBODIMENTS

Figure 1:
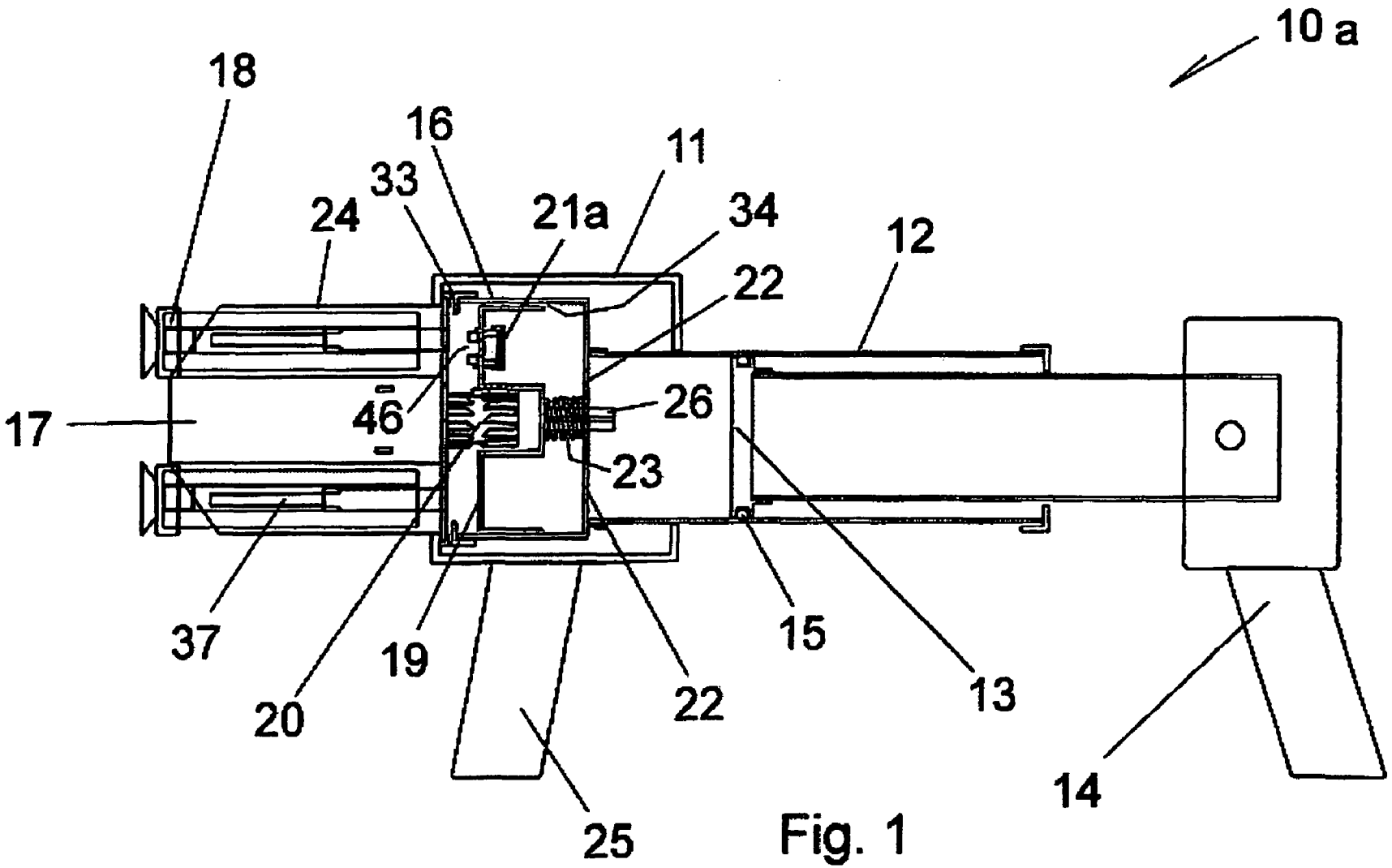
FIGS. 1, 2 and 3 are schematic cross-sectional elevations of toy guns having different air delivery advancing mechanisms.
Figure 2:
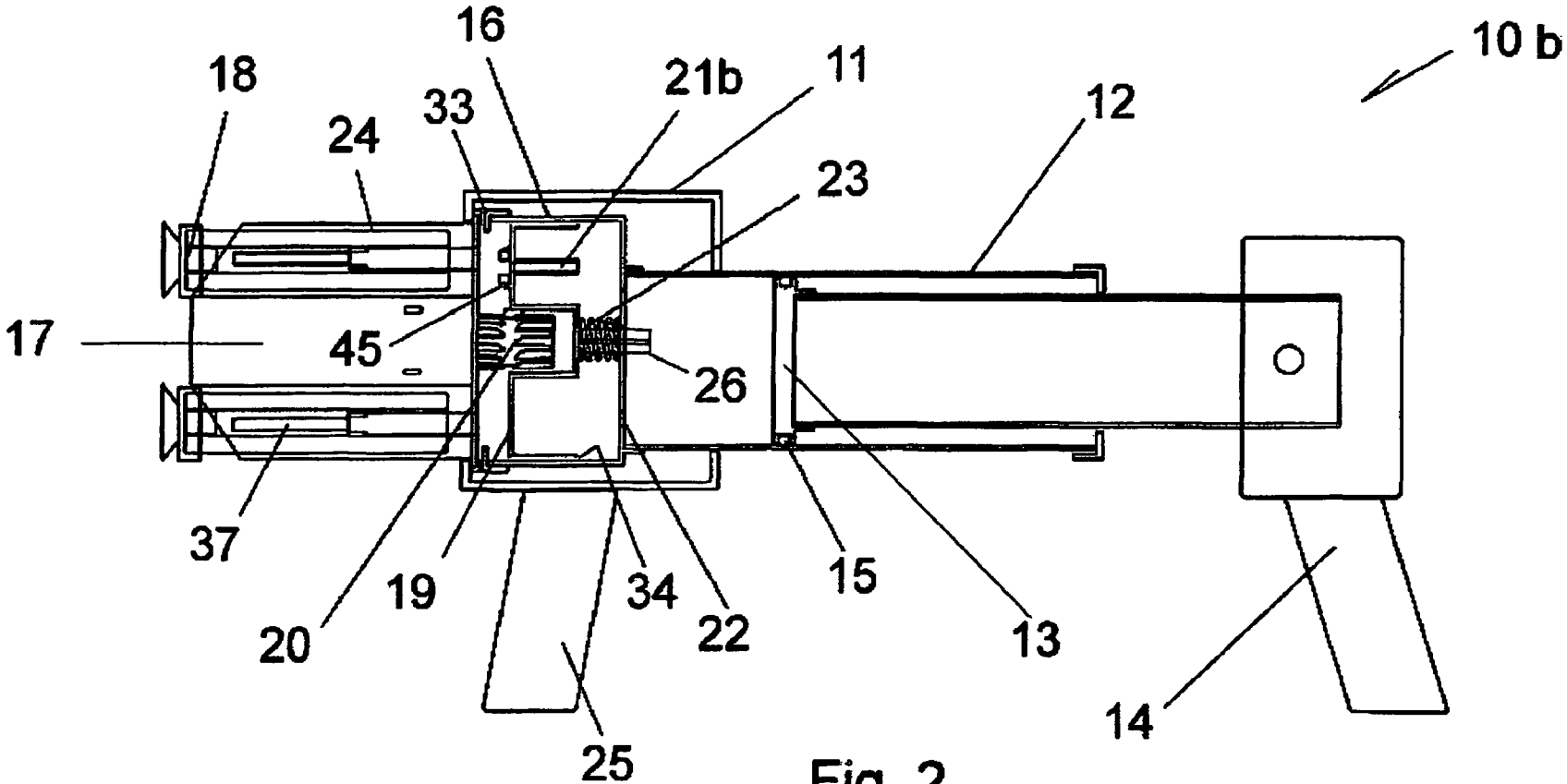
Figure 3:
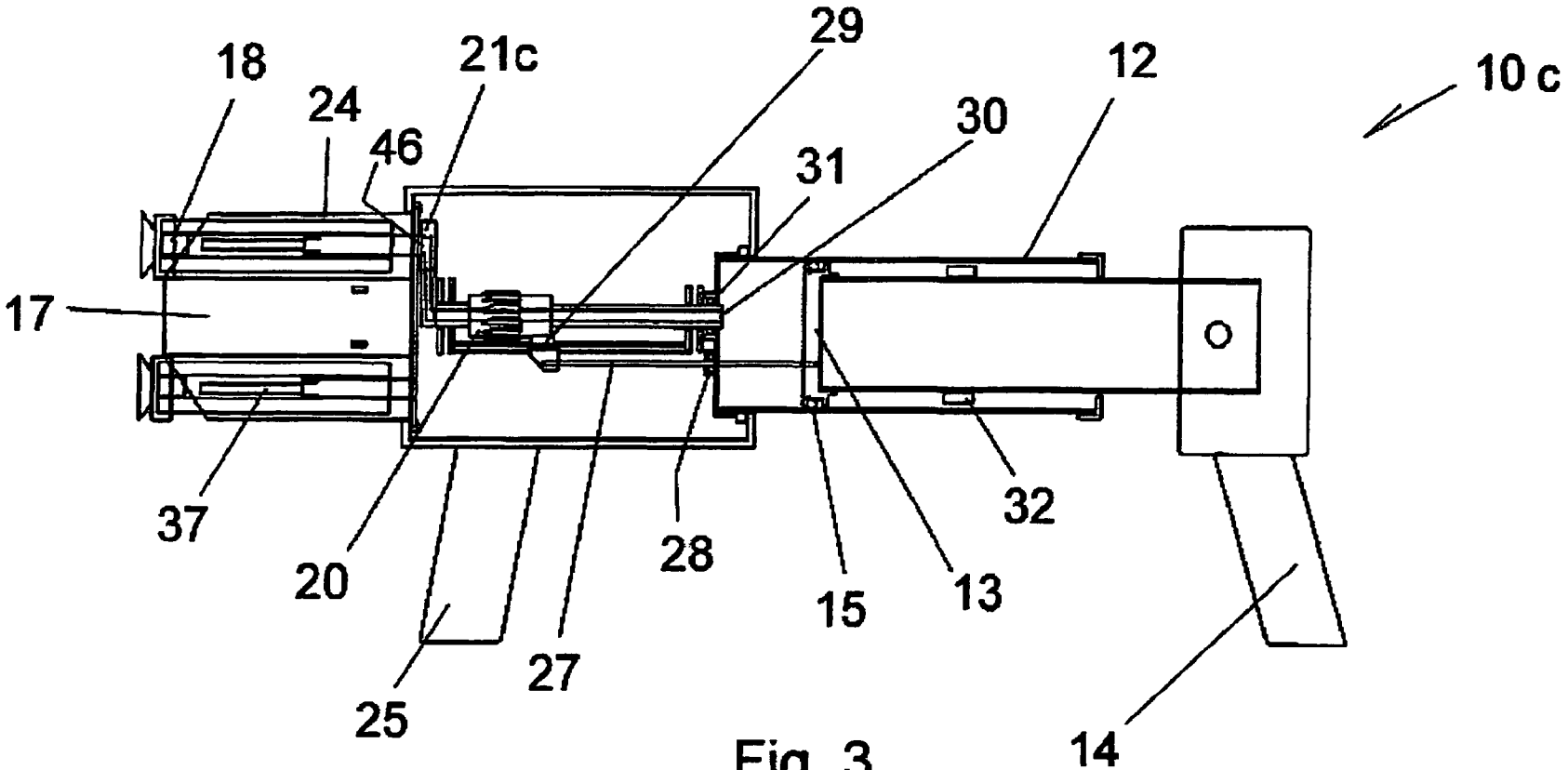

FIGS. 1 to 3 of the accompanying drawings depict toy guns of similar construction, although each comprises a different means of indexing the delivery of compressed air from one firing chamber to the next.

In FIG. 1 there is depicted schematically a toy gun 10*a* including a body 11 and a cylinder 12 extending rearwardly from the body 11. The cylinder 12 could alternatively be housed inside the body 11. A piston 13 having an O-ring 15 slides linearly within the cylinder 12. A stopper 32 prevents over-extension of the piston. The body 11 has a first handle 25 and the piston 13 has a second handle 14. In use, the first handle is grasped by one hand and the second handle is grasped by the other. The handles are pumped in and out with respect to one another to fire projectiles in succession.

At the forward end of the body 11, there is provided a barrel 17. The barrel 17 is fixed with respect to the body 11 and comprises a plurality of projectile chambers 24 in a circular evenly-spaced array. Within each chamber 24 there is provided a nozzle 37. Individual soft projectiles 18 have hollow tail portions into which a nozzle 37 extends when the projectile is loaded within a firing chamber 24.

Located behind the barrel 17 is a cylindrical pressure chamber 16. At the back of the pressure chamber 16 vent holes 22 are provided via which air can pass back and forth between the pressure chamber 16 in the area immediately forward of the piston 13.

The pressure chamber 16 communicates with each of the firing chambers 24. Moreover, the nozzles 24 have air passages through them which extend to the pressure chamber 16.

Located within the pressure chamber 16 is a disc 19 which divides the pressure chamber into a pair of variable volume chambers. The disc 19 can move linearly within the pressure chamber 16 and can also rotate about its central axis. A guide pin 26 extends from the disc 19 and through an aperture in the rear wall of the pressure chamber and enables the disc to rotate as well as reciprocate. A disc return spring 23 surrounds the guide pin and serves to bias the disc 19 toward the barrel 17. There is a small air gap 34 between the periphery of the disc 19 and the internal surface of the pressure chamber 16 to allow a small amount of air to pass around the periphery of the disc. There is also a vent 33 forward of the disc 19 through which air can pass from the general interior of body 11 to the pressure chamber 16 forward of the disc 19. There is an airflow port 46 through the disc 19. A check valve 21*a* is located upon the disc 19 across the airflow port 46. The check valve is described in detail below with reference to FIGS. 16A, 16B and 16C. Aligned with and immediately in front of the check valve 21*a* is a seal 45 which surrounds the airflow port 46 and bears against the back of the barrel 17 when the disc 19 is in the fully forward position. Air passing through the airflow port 46 from the pressure chamber 16 via the check valve 21*a* therefore passes directly into nozzle 37 of one of the firing chambers 24.

The embodiment 10*b* of FIG. 2 is the same as that of FIG. 1, except that instead of providing a check valve 21*a* across the airflow port 46, an elongate tube 21*b* is provided which extends rearwardly of the disc 19 into the rear portion of the pressure chamber. The diameter and length of the tube is chosen to control air flow rate through the tube cause correct movement of the disc 19.

Fixed with respect to and extending from the back of the barrel 17 is an indexing hub 20. The indexing hub 20 extends into a central recess of the disc 19 and co-operates with the disc to cause rotation of the disc between successive projectile firings. Pressure fluctuations caused by the piston 13 within the pressure chamber 16 cause the disc 19 to move back and forth along the axis of the guide pin 26. The indexing hub 20 translates this linear movement of the disc into indexed rotation of the disc 19 to thereby sequentially align airflow port 46 with respective ones of the nozzles 37 between successive firings. The structure and operation of the indexing hub 20 will be described later with reference to FIGS. 10 to 15.

The embodiment 10*c* of FIG. 3 does not include a disc 19, but instead provides a rotating conduit 30 rotatably sealed to the pressure chamber in front of the piston 13 by a seal 31. The conduit has a radial segment at the forward end 21*c* at which an airflow port 46 is provided. Instead of the indexing hub 20 being affixed with respect to the back of the barrel 17 in this version, the indexing hub 20 is fixed about the axial portion of conduit 30. A metal rod 27 is fixed to and extends from the piston 13 through a seal 28 and has at its forward end a cam 29 which engages with ramped fingers which are spaced around the indexing hub 20. Upon retraction of handle 14, the rod 27 draws the cam 29 backward to bear upon the ramped leading edges of one of the fingers to cause the hub 20 and conduit 30 to rotate in unison, thereby indexing the airflow port 46 with the next firing chamber 24.

FIGS. 4A to 9B depict an embodiment of a toy gun 10*d* in which a trigger 36 is activated to release the energy of a piston spring 35. In this embodiment, the handle 25 is grasped by one hand and the other hand is used to activate the priming handle 14. Priming handle 14 is attached directly to the piston 13 to drawing back against the piston spring 35 whereupon a catch 38 retains the piston in a primed position. Activation of the trigger 36 releases the catch 38 so that the piston 13 moves rapidly forward to create projectile-firing pressure at the pressure chamber 16. The forward portion of the toy gun 10*d* is for all intents and purposes the same as that of FIG. 1 and these figures are intended to illustrate the operation of the disc 19 and the indexing mechanism. Reference will be made to FIGS. 10 to 15 in the description to follow.

Figures 4A, 4B:
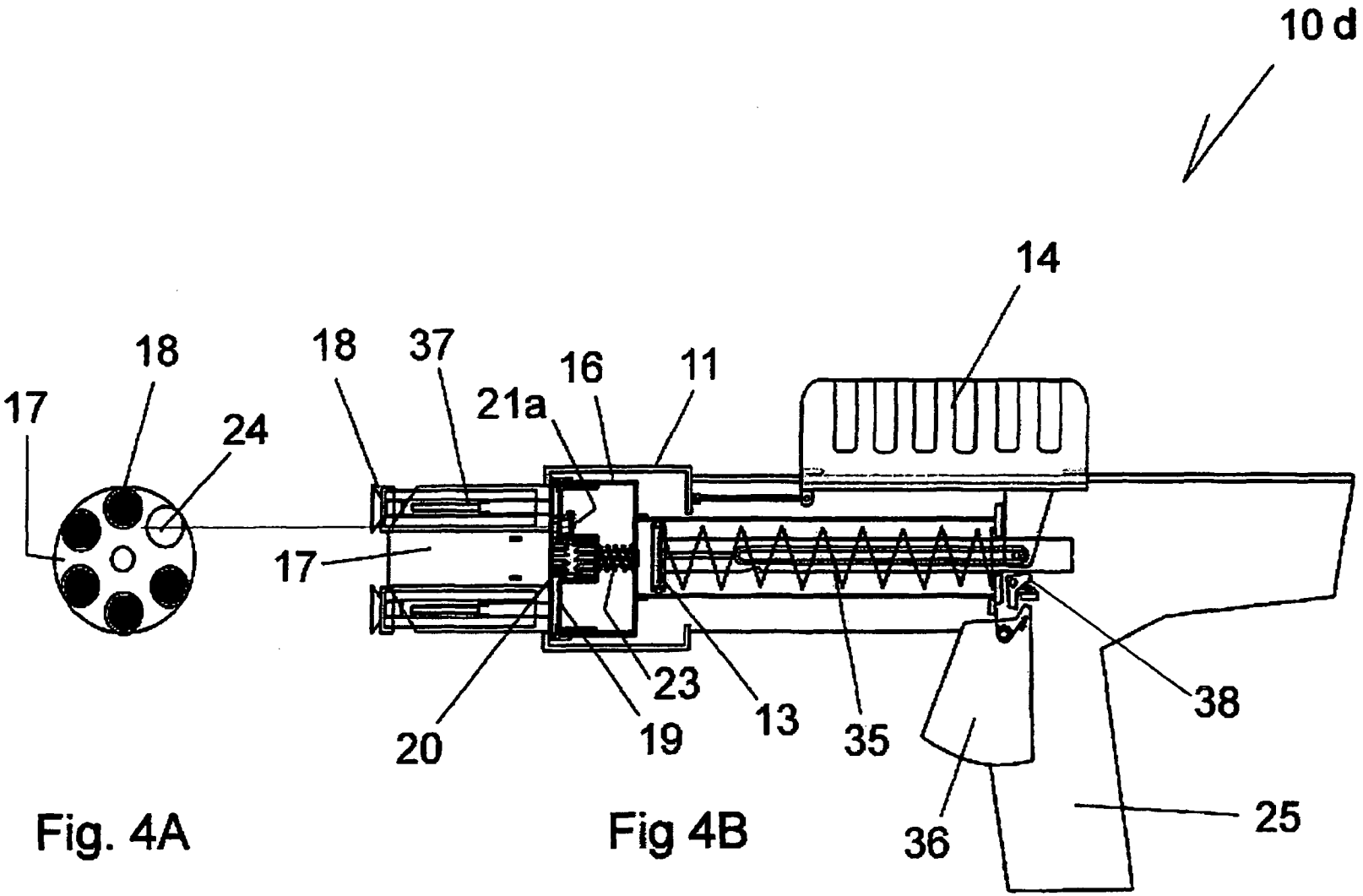
Figure 5B:
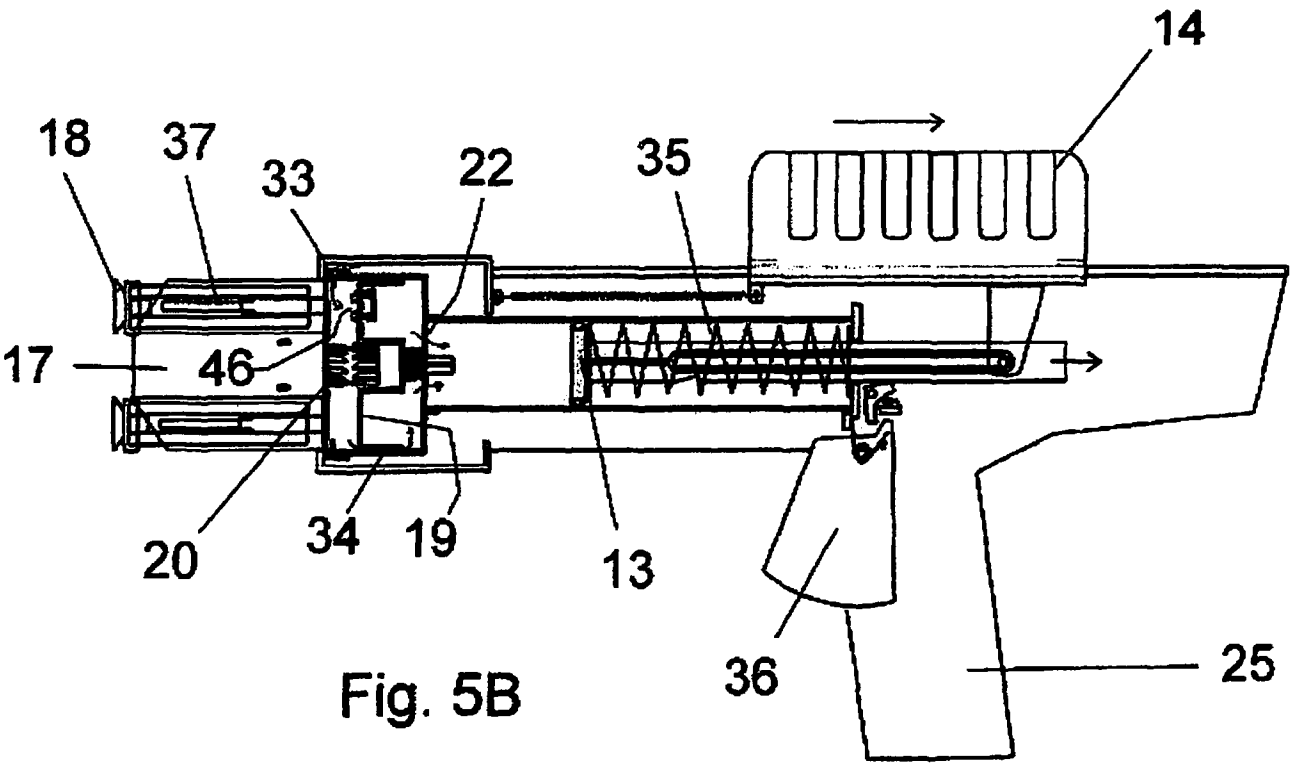
Figure 5A:
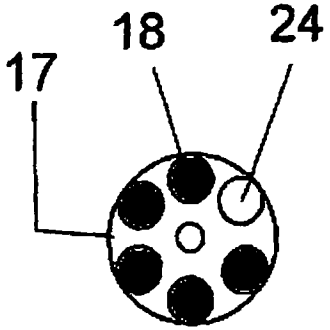

In the rest position as depicted in FIGS. 4A and 4B, the piston 13 is in the forward position and the barrel 17 has five of its six firing chambers 24 loaded with projectiles 18. The barrel 17 can hold six projectiles although five are shown to indicate the loading state after the first projectile has been dispatched from the toy gun. Priming handle 14 is drawn backward as indicated by the arrow in FIG. 5B to commence compression of piston spring 35. During this action, diminished air pressure behind in the disc 19 draws the disc backward and air is allowed into the forward portion of chamber 16 via vent 33 etc. Air also passes from the pressure chamber 16 through the vents 22 into the area immediately in front of piston 13.

Figure 6B:
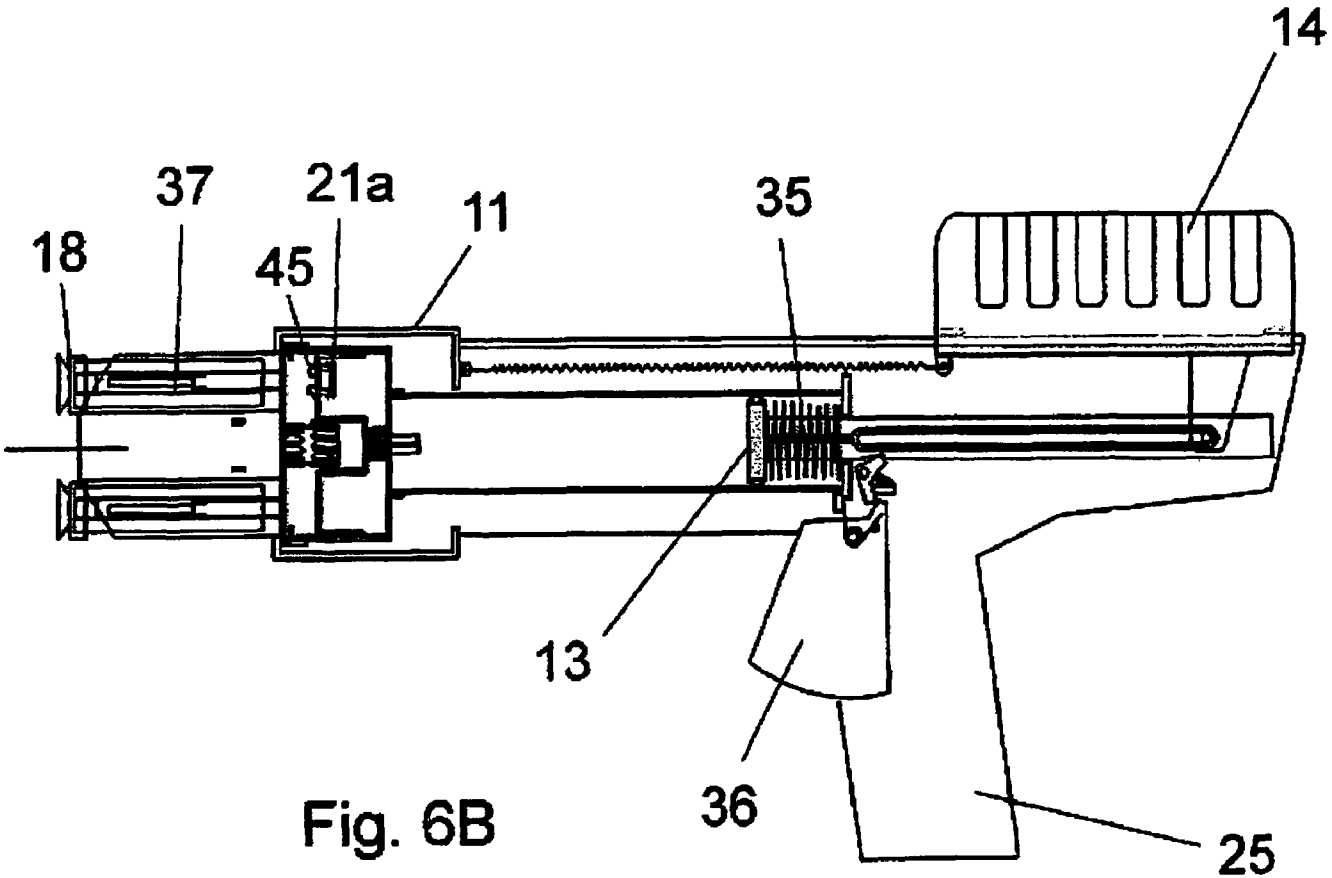
Figure 6A:
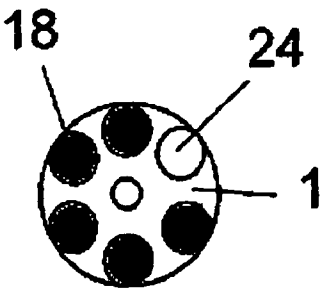
Figures 7A, 7B:
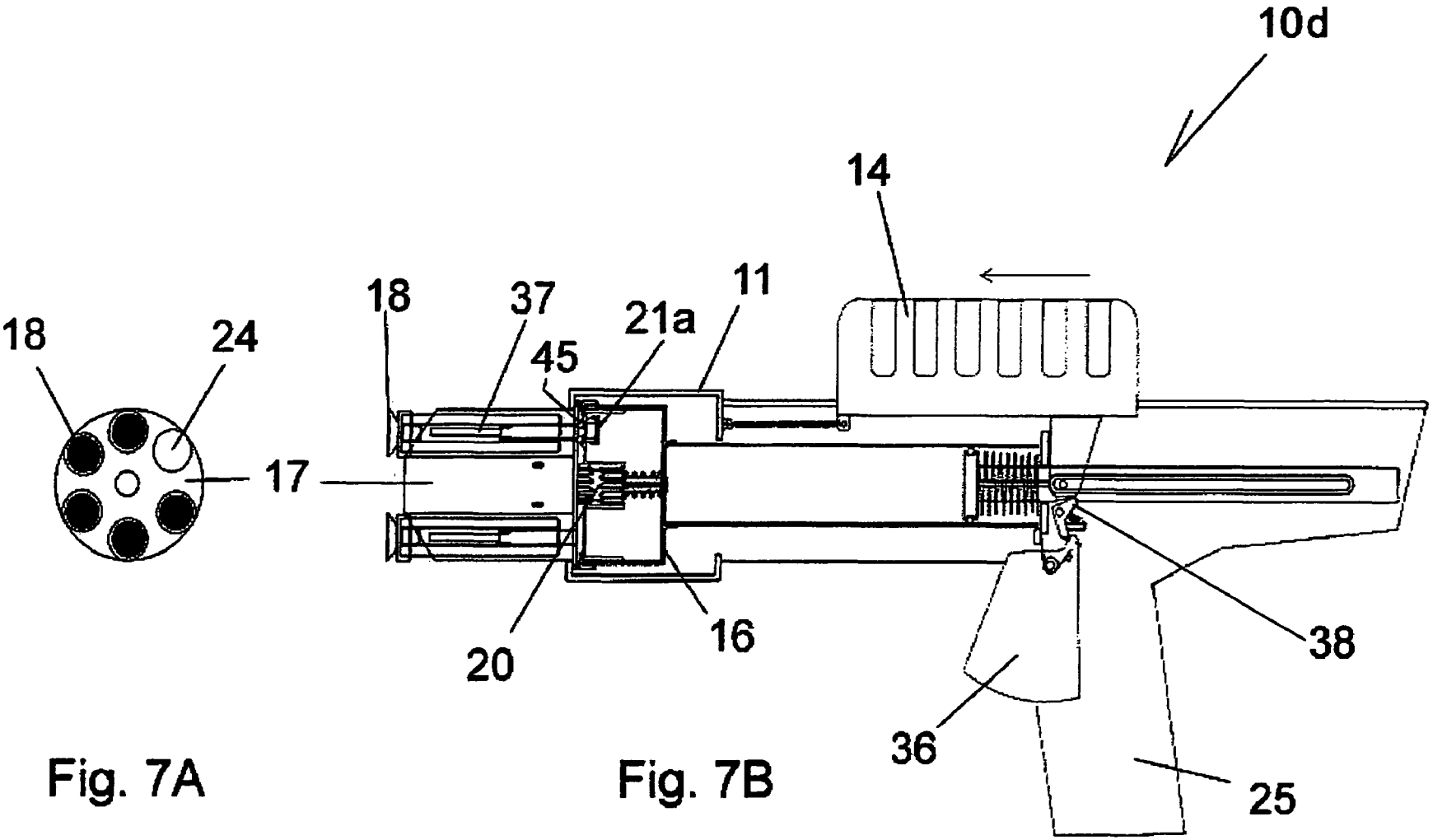
Figures 8A, 8B:
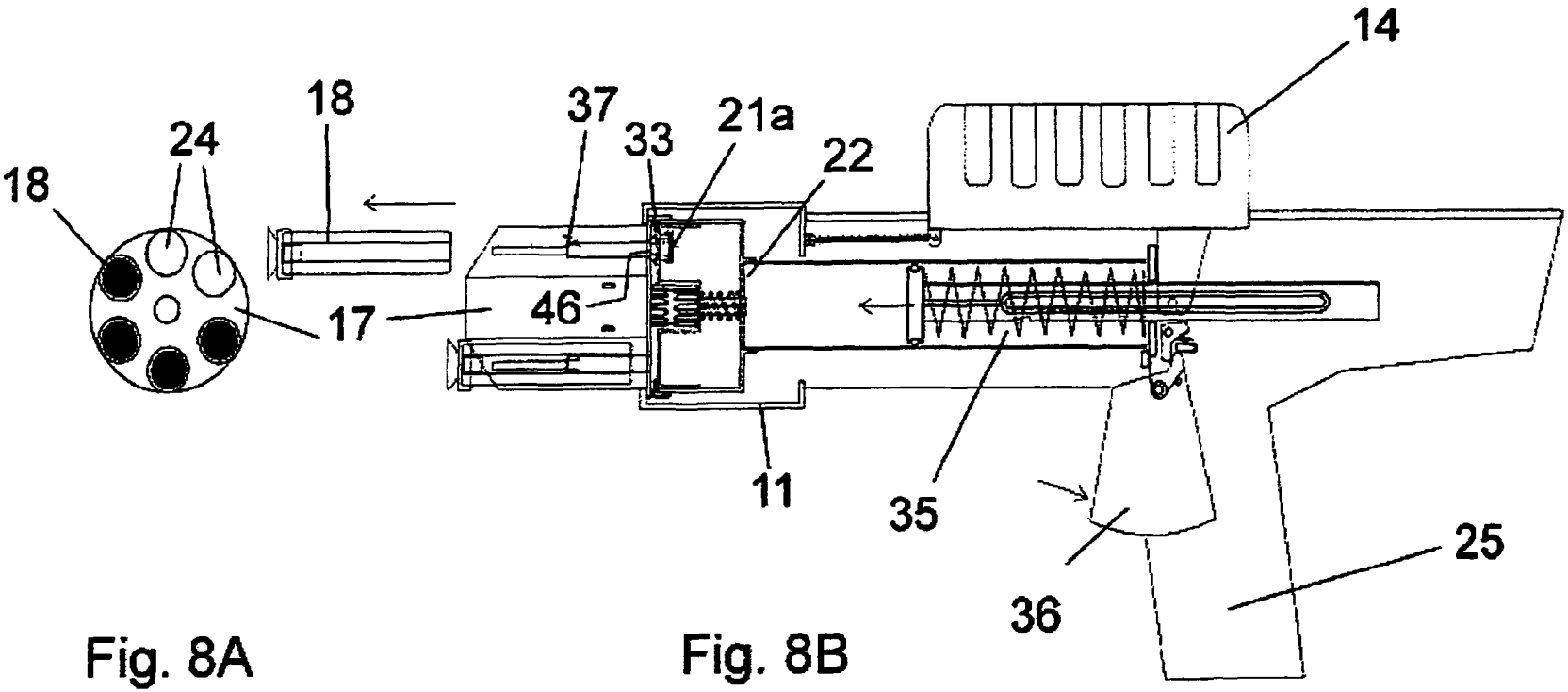
Figure 9B:
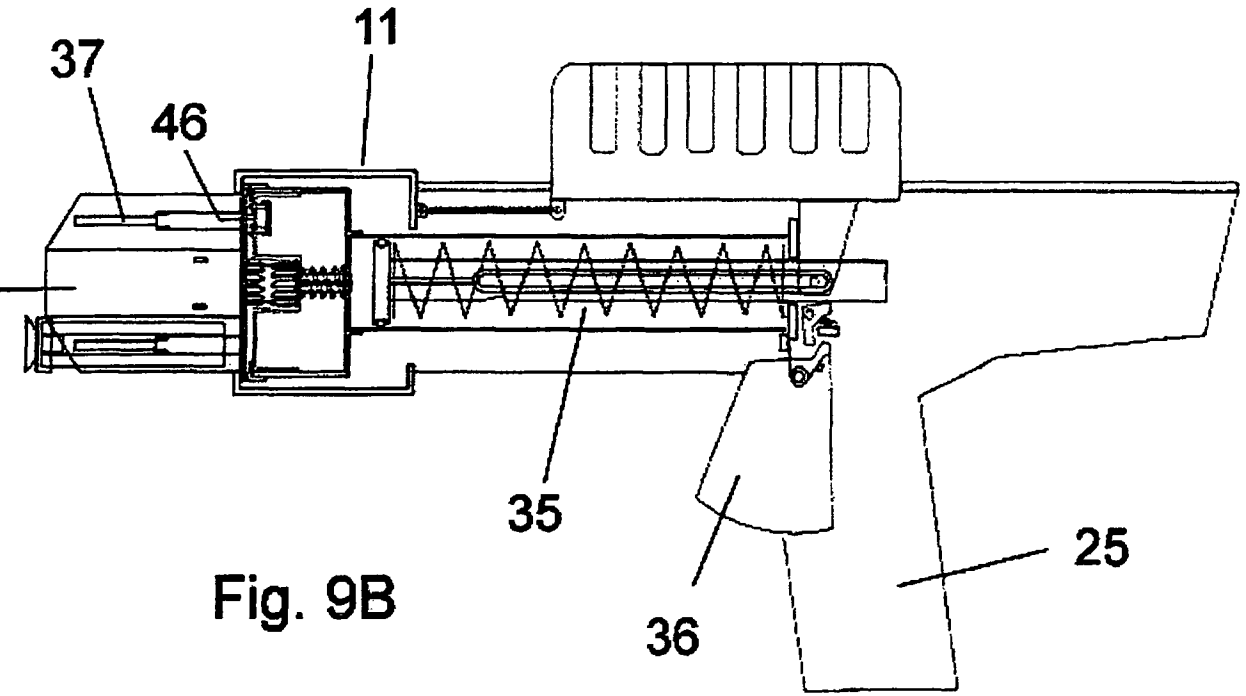
Figure 9A:
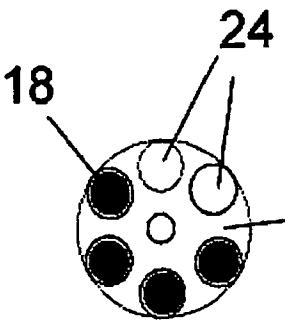
Figure 10:
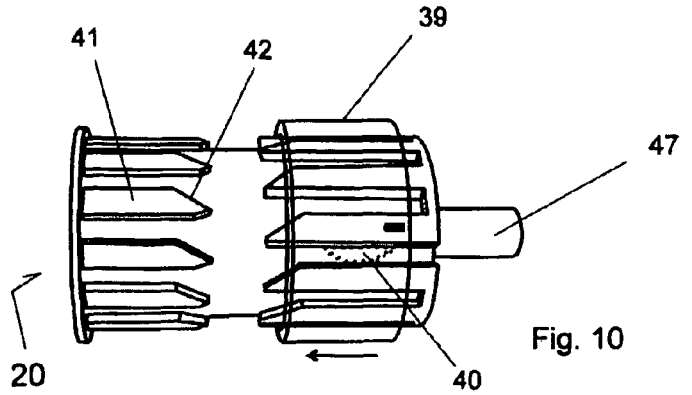
FIGS. 10 to 14 are schematic elevations of an air delivery advancing mechanism of the toy gun depicted in FIGS. 4B to 9B.
Figure 11:
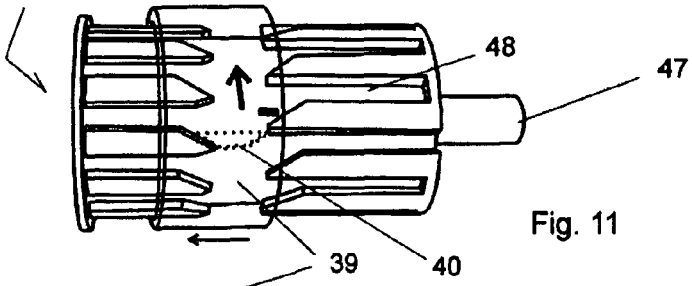
Figure 12:
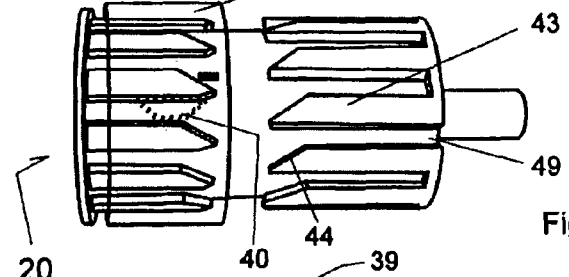
Figure 15:
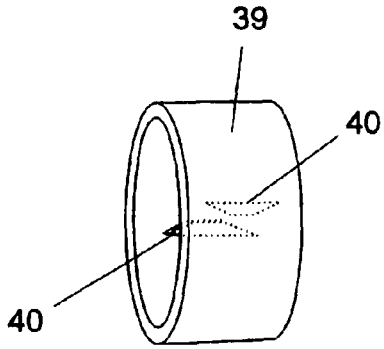
FIG. 15 is a schematic perspective illustration of an advancing ring forming part of the advancing mechanism.
Figure 13:
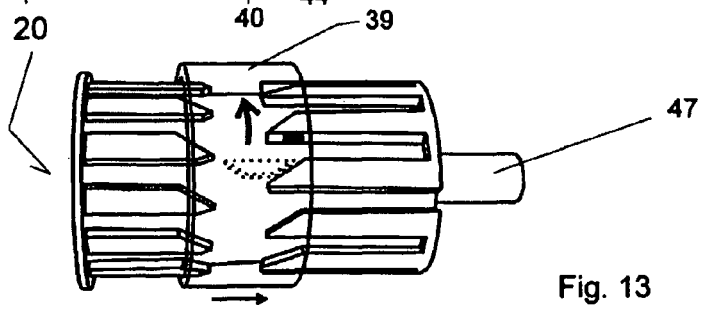
Figure 14:
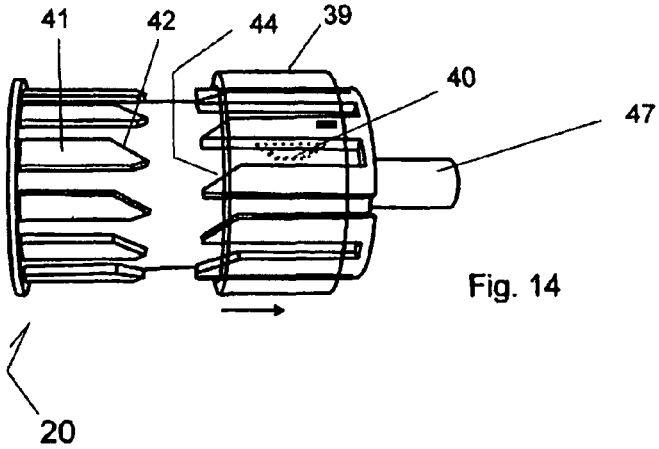

After the priming handle 14 is released from the position depicted in FIG. 6B it is drawn forward by a spring as shown by the arrow in FIG. 7B. Coincidentally, spring 23 biases disc 19 forward so that the seal 45 at port 46 seals the pressure chamber 16 with one of the nozzles 37. The catch 38 retains the piston until the trigger 36 is activated as indicated in FIG. 8B. The piston moves rapidly forward under the force of piston spring 35 and air rushes through the vents 22 and via the pressure chamber 16 and airflow port 46 into nozzle 37 causing projectile 18 to fire out of the toy gun. The piston comes to rest at the position depicted in FIG. 9B.

During the above procedure, the indexing mechanism is operative to rotate the disc 19 such that port 46 comes into alignment with successive firing chambers 24. FIGS. 10 to 14 illustrate the detail of the indexing mechanism.

The indexing mechanism includes a cylindrical drum 20 which is affixed to or formed integrally with the back of barrel 17. There is a spindle 47 over which the disc 19 can slide and rotate. This is not essential however.

At the forward portion of the drum 20, there is an array of fingers 41 each having a rear-facing ramp 42. At the rear portion of the drum 20 there is another array of fingers 43 each having a forward-facing ramp 44. The fingers are spaced peripherally about the drum 20 and are separated by grooves 48.

Surrounding the drum 20 is a ring 39. The ring 39 is formed integrally with or attached to the disc 19 within the central recess of the disc 19. The ring 39 is fixed with respect to the disc so as to rotate as one therewith. Formed on the internal surface of the ring 39 is a pair of diametrically opposed cams 40. The cams 40 fit within the grooves 48. To enable the drum 20 to be fitted into the ring 39, two of the grooves open at 49 to the end of the drum.

As noted earlier, pressure fluctuations within the pressure chamber 16 cause the disc 19 to reciprocate linearly. During this linear movement the cams 40 bear against the ramps 42 and 44. Relative linear motion in either direction will thereby cause rotation of the ring in one direction only as indicated by the arrows in FIGS. 11 and 13 thereby indexing the airflow port 46 as described.

Figures 16A, 16B:
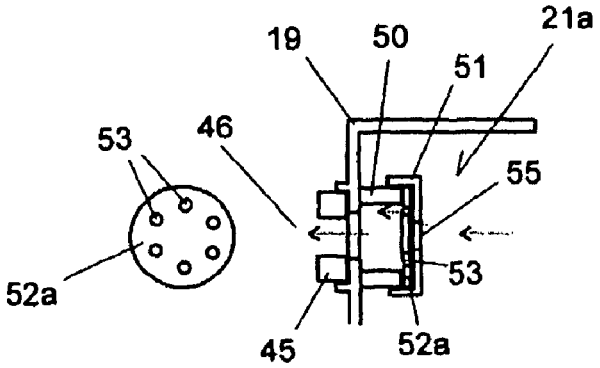
FIG. 16A is a schematic illustration of a check valve seal.
FIG. 16B is a schematic cross-sectional elevation of a portion of a disc having a check valve installed thereon and the seal of FIG. 16A in an open configuration.
Figure 16C:
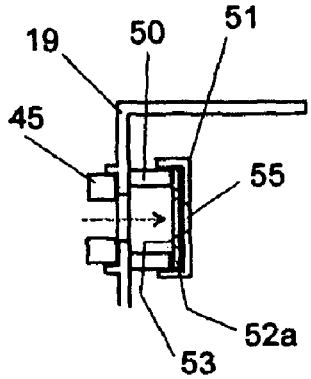
FIG. 16C is a schematic cross-sectional elevation similar to FIG. 16B, but showing the check valve seal in a closed configuration.

FIGS. 16A, B and C depict the check valve 21*a* in more detail. Attached to or formed integrally with the disc 19 behind the airflow port 46 and seal 45 is cylindrical body 50. A circular cap 51 fits over the cylindrical body 50 and includes a port 55. A flexible seal 52*a* is held in place against the end of the cylindrical body by the cap 51. The flexible seal 52*a* has a number of apertures 53 in a circular array. The diameter of the circular array is larger than the diameter of the port 55 in the cap 51. This allows the central portion of the flexible seal 52*a* to lift away from the port 55 to allow air to flow in the direction indicated by the arrow in FIG. 16A, but the central portion presses against the port 55 to prevent air from flowing in the direction indicated by the arrow in FIG. 16C.

Figures 17A, 17B:
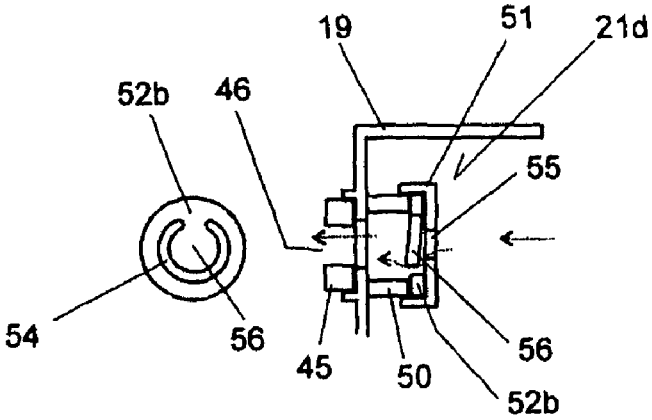
FIG. 17A is a schematic illustration of an alternative check valve seal.
FIG. 17B is a schematic cross-sectional elevation of a portion of a disc having a check valve installed thereon and the seal of FIG. 17A in an open configuration.
Figure 17C:
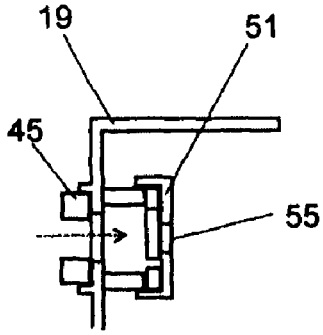
FIG. 17C is a schematic cross-sectional elevation similar to FIG. 17B, but showing the check valve seal in a closed configuration.

An alternative flexible seal 52*b* associated with a slightly different check valve 21*d* is shown in FIGS. 17A, B and C. The seal 52*b* includes a central portion 56 partly surrounded by a C-shaped aperture 54. The central portion 56 can hinge away from the port 55 as depicted in FIG. 17B to allow air to flow in the direction indicated by the arrow is in that figure. The central portion seals against the port 55 to prevent air from flowing in the direction indicated by the arrow in FIG. 17C.

Figures 18A, 18B:
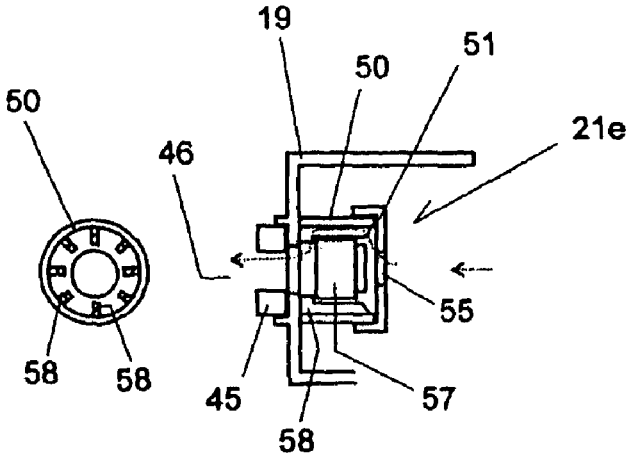
FIG. 18A is a schematic illustration of another alternative check valve seal.
FIG. 18B is a schematic cross-sectional elevation of a portion of a disc having a check valve installed thereon and a floating plug in an open configuration away from the seal of FIG. 18A.
Figure 18C:
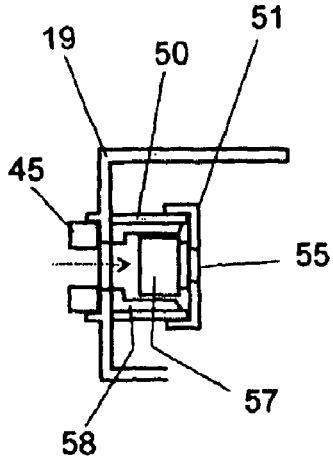
FIG. 18C is a schematic cross-sectional elevation similar to FIG. 18B, but showing the floating plug in a closed configuration pressed against to the seal.

A further option is depicted in FIGS. 18A to 18C. In this embodiment the cylindrical body 50 of a variation of the check valve 21*e* has internal guide ribs 58. A floating plug 57 resides within the cylindrical body 50 and can move longitudinally within it. The longitudinal airflow ribs 58 at the internal surface of the cylindrical body 50 enable air to flow around the plug 57. The plug 57 moves away from the cap 51 to allow air to flow through the port 55 and around the plug 57 via the slots between ribs 58 as indicated by the arrows in FIG. 18B. The plug 57 seals against the port 55 to prevent the back-flow of air in the direction indicated by the arrow in FIG. 18C.

It should be appreciated that modifications and alterations obvious to those skilled in the art are not to be considered as beyond the scope of the present invention.

What is claimed is:

1. A toy gun, comprising:

a body;

a piston adapted to move relative to the body between an extended position and a retracted position and to be moved rapidly toward the retracted position during a firing stroke;

a plurality of firing chambers in a circular array and each adapted to receive a projectile and to receive air compressed by the piston during a said firing stroke to fire the projectile from the toy gun;

an air delivery mechanism adapted to convey the compressed air to one of the firing chambers and co-operating with the piston to advance as a result of piston movement to a configuration whereat it can convey compressed air to another of the chambers;

a pressure chamber situated between the firing chambers and the piston and via which the compressed air is conveyed to the firing chambers; and the air delivery mechanism comprises a disc rotatable within the pressure chamber, the disc having a port with a check valve across it, the port aligned with one of the firing chambers, and means for rotatably indexing the disc to align the port with another one of the firing chambers.

2. The toy gun of claim 1, further comprising a first handle extending from the body to be grasped by one hand and a second handle extending from the piston to be grasped by another hand.

3. The toy gun of claim 2, further comprising a trigger associated with the first handle for releasing the piston.

4. The toy gun of claim 1, wherein each firing chamber further comprises an ejection nozzle via which air compressed by the piston is delivered to a projectile during the firing stroke.

5. The toy gun of claim 1, wherein the air delivery mechanism comprises a conduit extending from the pressure chamber to one of the firing chambers, and means for rotatably advancing the conduit to align the conduit with another one of the firing chambers.

6. A toy gun, comprising:

a body;

a piston adapted to move relative to the body between an extended position and a retracted position and to be moved rapidly toward the retracted position during a firing stroke;

a plurality of firing chambers in a circular array and each adapted to receive a projectile and to receive air compressed by the piston during a said firing stroke to fire the projectile from the toy gun, an air delivery mechanism adapted to convey the compressed air to one of the firing chambers and co-operating with the piston to advance as a result of piston movement to a configuration whereat it can convey compressed air to another of the chambers;

a pressure chamber situated between the firing chambers and the piston and via which the compressed air is conveyed to the firing chambers; and wherein the port includes a tube extending into the pressure chamber.

7. The toy gun of claim 6, further comprising a seal for sealing the port against each firing chamber.

8. A toy gun, comprising:

a body;

a piston adapted to move relative to the body between an extended position and a retracted position and to be moved rapidly toward the retracted position during a firing stroke;

a plurality of firing chambers in a circular array and each adapted to receive a projectile and to receive air compressed by the piston during a said firing stroke to fire the projectile from the toy gun;

an air delivery mechanism adapted to convey the compressed air to one of the firing chambers and co-operating with the piston to advance as a result of piston movement to a configuration whereat it can convey compressed air to another of the chambers;

a pressure chamber situated between the firing chambers and the piston and via which the compressed air is conveyed to the firing chambers; and wherein the air delivery mechanism comprises a disc adapted to move linearly within the pressure chamber and rotatable within the pressure chamber, the disc having a port aligned with one of the firing chambers, and means for rotatably indexing the disc to align the port with another one of the firing chambers.

9. The toy gun of claim 8, wherein said means for rotatably indexing the disc comprises a substantially cylindrical hub fixed with respect to the body and a ring attached to or formed integrally with the disc and surrounding the hub, the hub having an array of indexing fingers, the ring having one or more cams which engage upon linear movement of the disc with one or more of the fingers to rotate the disc.

10. The toy gun of claim 8, wherein the disc is biased by a spring toward the firing chambers.

11. A toy gun, comprising:

a body;

a piston adapted to move relative to the body between an extended position and a retracted position and to be moved rapidly toward the retracted position during a firing stroke;

a plurality of firing chambers each adapted to receive a projectile and to receive air compressed by the piston during a said firing stroke to fire the projectile from the toy gun;

an air delivery mechanism adapted to convey the compressed air to one of the firing chambers and co-operating with the piston to advance as a result of piston movement to a configuration whereat it can convey compressed air to another of the chambers;

a pressure chamber situated between the firing chambers and the piston and via which the compressed air is conveyed to the firing chambers;

the air delivery mechanism comprises a conduit extending from the pressure chamber to one of the firing chambers, and means for rotatably advancing the conduit to align the conduit with another one of the firing chambers; and wherein said means for rotatably advancing the conduit comprises a substantially cylindrical hub fixed with respect to the conduit and a cam attached to the piston, the hub having an array of indexing fingers, the cam engaging upon movement of the piston with one or more of the indexing fingers to rotate the hub and conduit.

* * * * *